United States Patent [19]

McLerran et al.

[11] Patent Number: 4,593,898

[45] Date of Patent: Jun. 10, 1986

[54] BICYCLE EXERCISING MEANS AND METHOD

[76] Inventors: Carl M. McLerran, 4816 Summers La., Klamath Falls, Oreg. 97603; Robert E. Johnson, 2890 Woodridge Cir., Carlsbad, Calif. 92008

[21] Appl. No.: 624,454

[22] Filed: Jun. 25, 1984

[51] Int. Cl.[4] ..... A63B 21/00

[52] U.S. Cl. ..... 272/73; 272/DIG. 4

[58] Field of Search ..... 272/73, 69, DIG. 4; 211/17, 1, 22; 280/212, 215, 217, 289 R, 289 D

[56] References Cited

U.S. PATENT DOCUMENTS

| | | | |
|---|---|---|---|
| 3,107,915 | 10/1963 | Looney | 272/73 |
| 3,724,844 | 4/1973 | Olmstead | 272/73 |
| 3,735,981 | 5/1973 | Mallin | 272/73 |
| 3,758,107 | 9/1973 | Potgieter | 272/73 |
| 4,061,460 | 12/1977 | George | 425/459 |
| 4,421,308 | 12/1983 | Nagy | 272/73 |
| 4,505,473 | 3/1985 | Pro | 272/73 |

FOREIGN PATENT DOCUMENTS 166096 6/1950 Austria .

*Primary Examiner*—Richard J. Apley
*Assistant Examiner*—John Welsh
*Attorney, Agent, or Firm*—Duane C. Bowen

[57] ABSTRACT

Bicycle exercising apparatus is provided by a standard bicycle having its rear wheel supported by a stand and by a flywheel having its side tensed against the rear tire to be driven by the rear tire to provide drag. The stand adjusts drag by changing the distance between the axis of rotation of the flywheel and the plane of the rear wheel. The stand includes a pair of struts pivotally attached to the stand and having a vee supporting relationship to the bicycle hub both in side and top views of the assembly. One strut of each pair has a telescopically adjustable arm supporting cup-shaped fittings engaging the nuts at the ends of the axle bolts of the rear wheel.

15 Claims, 15 Drawing Figures

Fig. 3
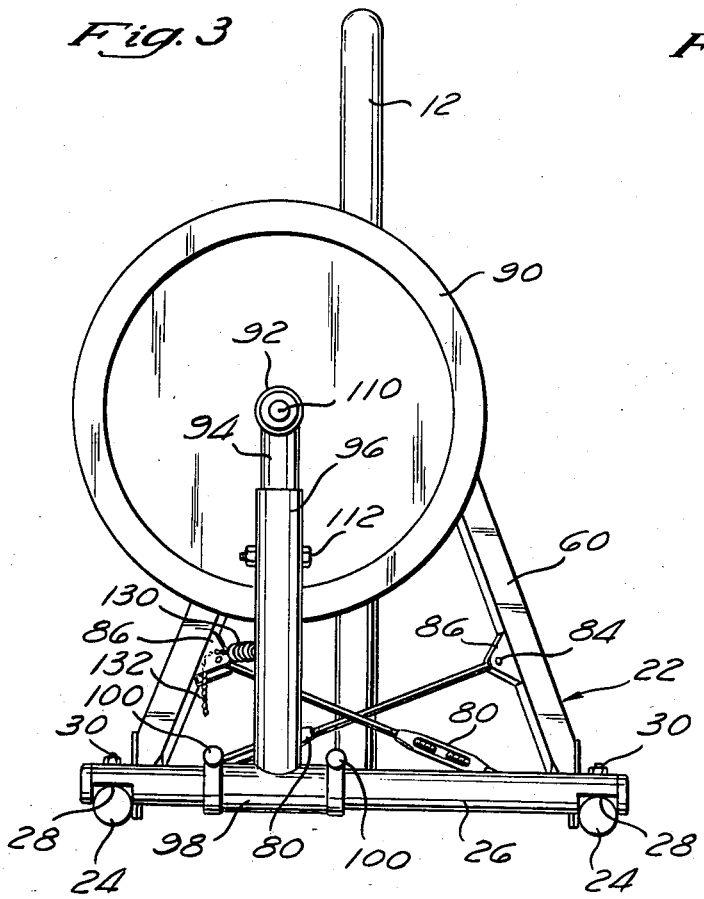
Fig. 6
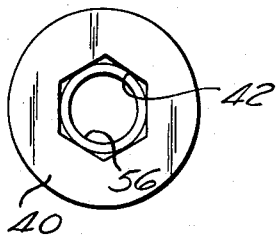
Fig. 7
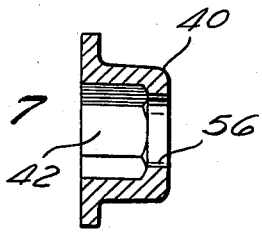
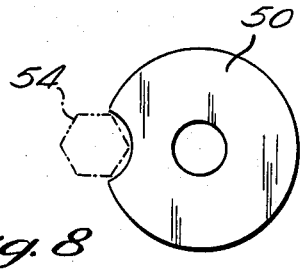
Fig. 8
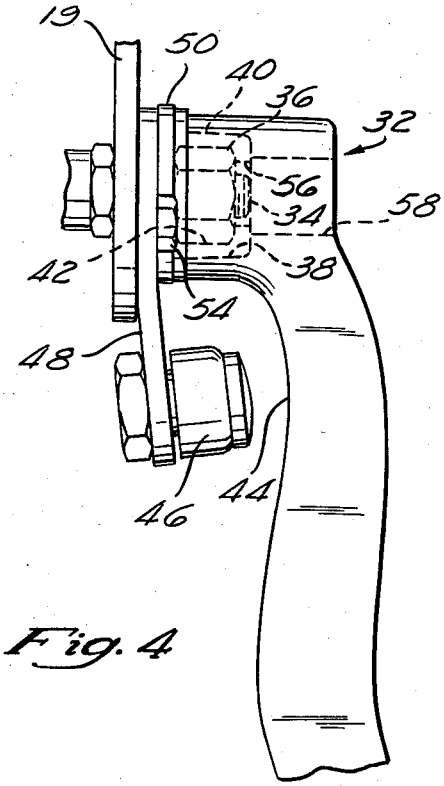
Fig. 4
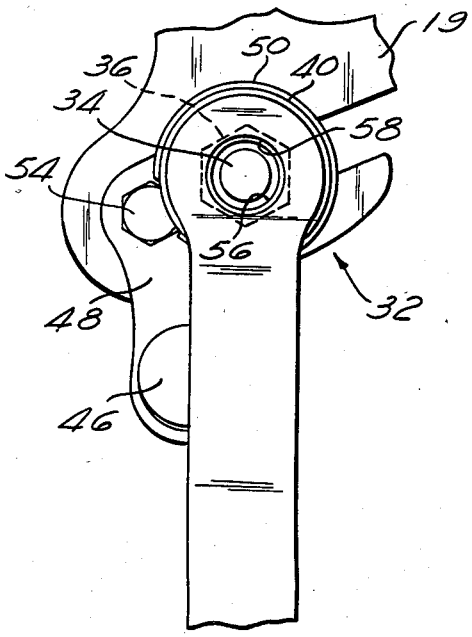
Fig. 5

BICYCLE EXERCISING MEANS AND METHOD

BRIEF EXPLANATION OF THE INVENTION

Background and Objectives

Our invention relates to a means and a method of exercising which utilizes a standard bicycle but operates in the manner of a stationary exercising bicycle.

In exercising apparatus of a bicycle type, the following are considered to be important characteristics:

(1) To provide equipment that (a) is durable, (b) is bicycle-like in operation and (c) is of economical cost. To achieve those combined characteristics, it is advantageous to use a standard bicycle, because (a) a standard bicycle is durable, (b) the use of a standard bicycle will add to the similarity to road bicycle operation, and (c) cost will be substantially reduced, presuming the user already owns a standard bicycle.

(2) To contribute to adjustability of drag, and to contribute to the sensation of inertia, tending to continue operation (characteristic of a bicycle on the road), by use of a flywheel.

Our invention will be best understood, together with additional advantages and objectives thereof, when read with reference to the drawings.

THE DRAWINGS

FIG. 3 is a rear view of the same.

FIG. 4 is an enlarged end view of a fitting engaging the bicycle axle.

FIG. 5 is a side view of the same.

FIG. 6 is an enlarged side view of a cup to engage a nut on the axle.

FIG. 7 is an end sectional view of the same.

FIG. 8 is a face view of a cut-out washer. A nut being avoided is shown in dashed lines.

DESCRIPTION

Figure 2:
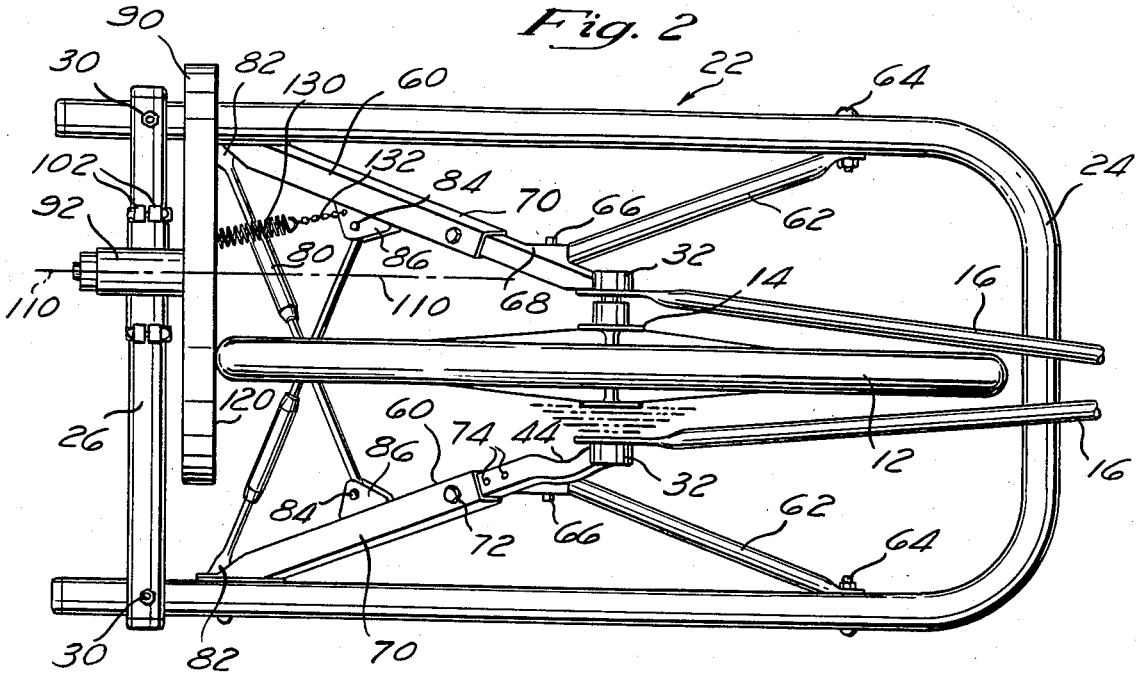
FIG. 2 is a top view of the stand and bicycle shown in FIG. 1.
Figure 1:
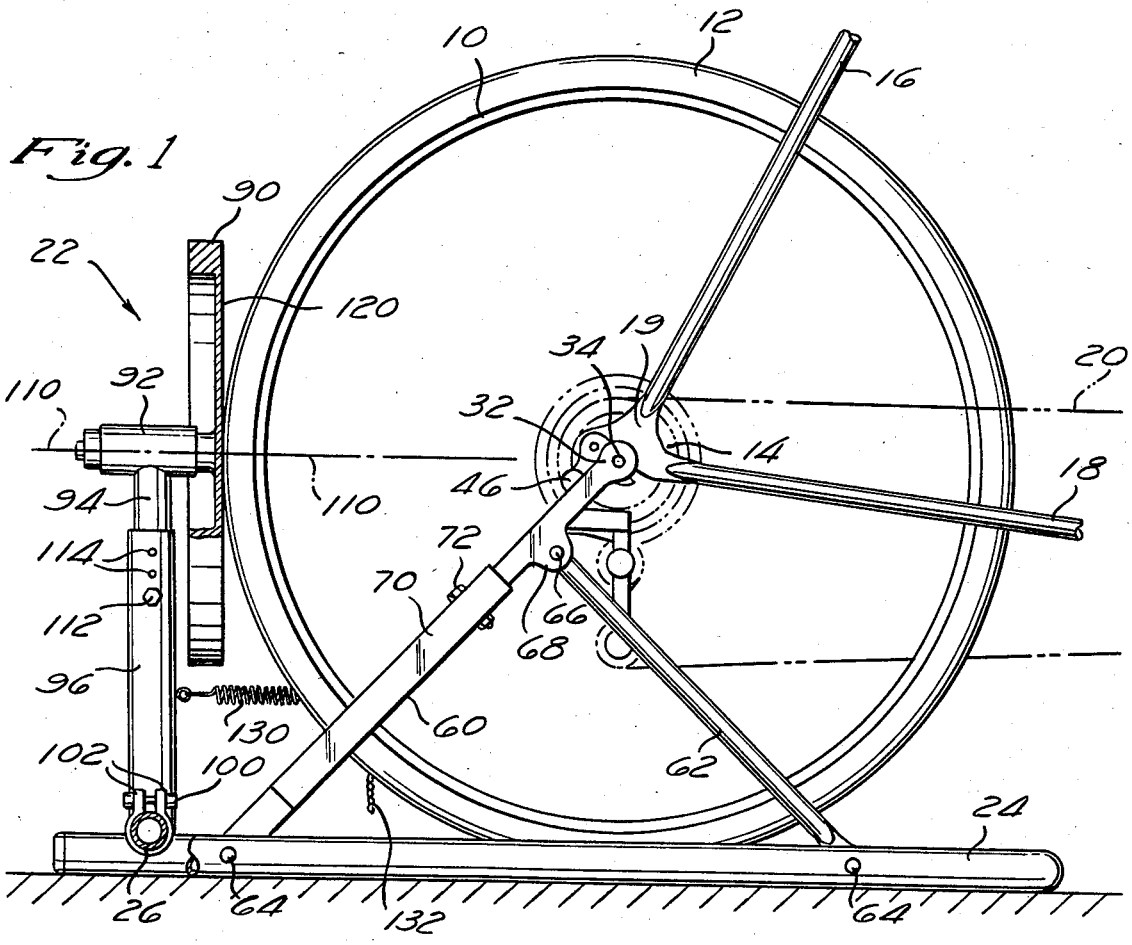
FIG. 1 is a side view of a specific embodiment of our invention including a stand and portions of a standard bicycle, including the rear wheel and tire, supported on the stand. A portion of a flywheel is broken away and shown in section.
Figure 9:
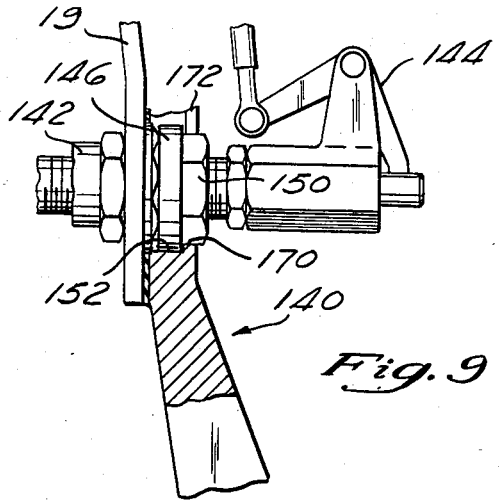
FIG. 9 is a top view, partly in section, of a modified fitting engaging a bicycle axle. This modified fitting adapts to a particular type of three-speed bicycle change mechanism presently on the market.
Figure 10:
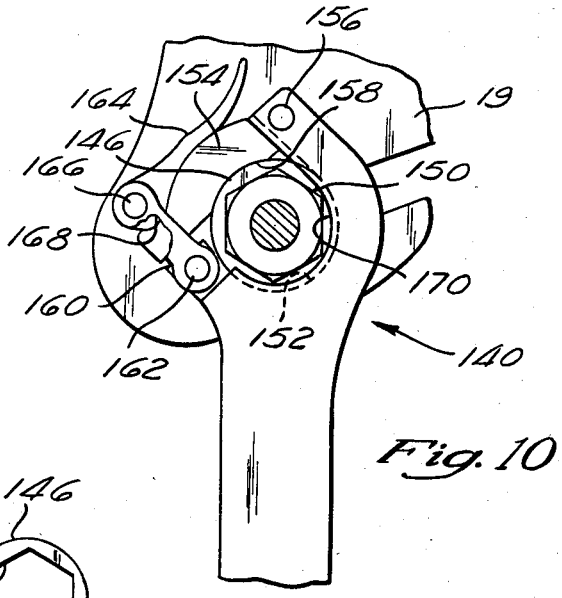
FIG. 10 is a side view of the structure shown in FIG. 9.
Figure 11:
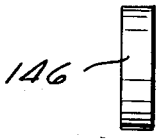
FIG. 11 is a side view of a collar used with the fitting shown in FIGS. 9 and 10.
Figure 12:
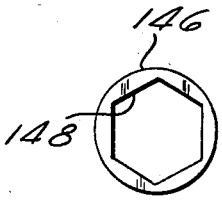
FIG. 12 is a face view of the collar shown in FIG. 11.

A standard bicycle is represented in the drawings by parts thereof including a rear wheel 10, a rear tire 12, a rear hub 14, rear braces 16, 18 joined by forks 19, and drive chain 20. From the following description it will be understood that any standard or common bicycle, available on the market, could be used for the bicycle part of the apparatus.

A stand 22 is provided having a base, to rest on the floor, formed by a U-shaped tube 24 and a tube 26 forming a cross-member having cut-outs 28 as its ends to engage the ends of the tube 24 and secured thereto by bolts 30.

The rear wheel 10 of the bicycle is supported with the tire 12 clearing the floor by fittings 32 engaging the opposite ends of the axle 34 of hub 14. Bolt axle 34 is secured in forks 19 by nuts 36 and fittings 32 engage nuts 36.

Fittings 32 can be formed in a number of ways as will be understood by those skilled in the art, i.e., forged as one piece from solid stock or having a cup welded to solid or tubular stock, etc. However formed, fittings 32 include a cup-shaped cavity 38 (may be machined) receiving a cup 40 fitting nut 36. As nuts 36 on standard bicycles may have different sizes, as related above, several cups 40 need to be provided all having the same exterior dimensions to fit cup-shaped cavity 38 (with suitable draft) but having different sized hexagonal interior cavities 42 to fit the different sized nuts. In the assembly of nut 36, cup 40 and fitting 32, the parts are brought together to seat cup cavity 42 on nut 36 and cup 40 rotatably adjusts to the clocking of nut 36. Some draft to cavity 42 will assist in adjustment to nut 36 in the seating process. Cup 40 could be molded from high impact plastic or could be formed of die-cast metal. Common nut sizes at present are 15 and 16 mm.

The bicycle hub assembly shown in the drawings is of the ten-speed derailer type, as will be recognized by those skilled in the art. Fitting 32 on the right side of the bicycle looking forward has a bend 44 to clear knob 46 on arm 48 in the derailer mechanism. A washer 50 is provided having a cutout 52 to clear a nut 54 which is part of the standard derailer assembly.

A bicycle with a coaster-brake type hub assembly is accommodated by the fitting structure shown without difficulty, although bend 44 in fitting 32 and cut-out washer 50 are not needed. A standard three-speed bicycle has a chain coming out of the axis of the axle in the hub mechanism and the chain is permitted to pass by axial openings 56, 58 in cup 40 and fitting 32 respectively. In order to thread through openings 56, 58, the chain should be interrupted by a quick disconnect, as will be understood by those skilled in the art.

FIGS. 9–12 show another type of 3-speed bicycle and a different type of fitting to engage the hub structure on the right side, whereas the fitting illustrated in FIGS. 4–8 could be used on the left side. The FIGS. 9–12 fitting will be discussed later in this description. The support of fittings 32 (to support the rear wheel 10 of the bicycle) includes a rear strut 60 and a forward strut 62 on each side of the bicycle. Struts 60, 62 are pivotally secured to base tube 24 by bolts or rivets 64. Struts 60, 62 form vees both in side and top views and are pivotally connected by a pin 66 extending through an opening in the upper end of forwrd strut 62 and an opening in a lug 68 welded to fitting 32. Rear strut 60 is formed by two parts, a lower part 70 and fitting 32 that telescopes into lower part 70. To adjust for 24", 26" and 27" bicycles, the height of fitting 32 needs to be raised or lowered and this is accomplished by the telescoping of rear strut 60. Strut 60 is secured in adjusted length by a bolt 72 extending through an opening in lower strut part 70 and through one of several openings 74 in fitting 32. Note that strut 60 is disposed at 45 degrees as viewed from the side. This means when strut 60 is varied in length to adjust to the size of bicycles, i.e., from 26" to 27" bicycles, the change in length of strut 60 equally changes the height of bolt axle 34 and its distance from flywheel 90. In other words, strut 60 makes two adjustments at the same time when it is telescopically adjusted in length.

Struts 60, 62 flex during securing and removal of a bicycle hub 14 from engagement by fittings 32. They are secured in position locking fittings 32 to bicycle hub 14 by turnbuckles 80 pivotally connected at their lower ends at 82 to tube 24 and pivotally connected at their upper ends at 84 to lugs 86 welded to rear strut portion 70.

A flywheel 90 is suitably rotably mounted by a fitting 92 forming a bearing and welded to the upper end of an upper upright tube 94 telescoping into a lower upright tube 96. The lower end of tube 96 is welded to a cross-tube 98 slidably mounted on base cross-tube 26. The ends of tube 98 are abutted by clamping split collars 99 and are fabricated to clamp tube 26 in adjusted position by tightening bolts 100 extending through openings in lugs 102. Each clamp 99 can be fabricated by welding a small tube (forming lugs 102) laterally of the end of a larger tube and by splitting (by milling) small tube 102 and the adjacent portion of the larger tube. The clamp 99 then can be severed from the remainder of the larger tube.

The axis of rotation 110 of flywheel 90 preferably should be at about the level of axis of bicycle axle 34 and the vertical adjustment to achieve that end is obtained by telescopic adjustment of upper tube 94 in lower tube 96 and by change of the position of bolt 112 in openings 114 in tube 96. The axis of bicycle axle 34 of course is raised or lowered to clear the floor depending on the size of the bicycle, i.e., 24", 26", or 27".

Flywheel 90 has a flat side 120 to abut bicycle tire 12. Drag of flywheel 90 is adjusted by the distance from flywheel axis of rotation 110 to the plane of bicycle wheel 10. Adjustment of drag of flywheel, thus, is achieved by adjustment of the position of cross-tube 98 on cross-tube 26. Cross-tube 98 is secured in adjusted position by tightening of the clamping bolts 100. If it were deemed desirable to adjust the drag more frequently, means could be substituted to quickly change the position of cross-tube 98 on cross-tube 26, but the change would add to the cost of the equipment. It is felt most people will only want one adjustment of drag, to a level believed to give adequate level of exercise when the bicycle is pedalled.

Flywheel 90 should be pressed to rear tire 12 to insure traction and a tension spring 130 secures to tube 96 and to one of the struts 70 to bias flywheel 90 against tire 12. Spring 130 ends in a chain 132 at one end so that it can adjustably secure to a hook on strut 90. The force of spring 130 can be varied depending on which link of chain 132 is engaged with the hook. The drag of spring 130 also can be varied by substituting a weaker or stronger spring.

When the expression "standard bicycle" is used in the claims, we mean that bicycles commonly found on the market can be used, as distinguished from a bicycle that must be specially fabricated for this use.

FIGS. 9–12 show a different type of fitting 140 to engage the hub structure 142 at least on the right side of a three-speed bicycle having the gear change mechanism 144 depicted. Fitting 140 is a substitute for the fitting 32 of FIGS. 1–5 and has a telescopic relationship for the size of the rear bicycle wheel 10. A collar 146 has a hexagonal opening 148 to fit on hub nut 150 and has a circular outer contour so that it can be engaged in any clocked position by fitting 140. Fitting 140 has a generally semicircular rest 152 engaging collar 146 and has a latching mechanism incuding a latch member 154 pivotally connected at 156 and having a rest recess 158 formed as a generally circular arc. A latch piece 160 has a through opening receiving the end of latch member 154. Latch piece 160 is pivotally connected at 162 and a latching lever 164 is pivotally connected at 166 to latch piece 160. Lever 164 has a camming locking surface 168 which goes "over center" in latching fitting 140 to collar 146. Rests 152 and 154 may be bordered by lips 170, 172 that will help retain collar 146.

Figure 15:
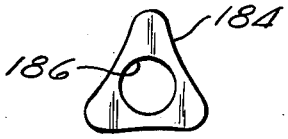
FIG. 15 is a face view of an adapter plug used with the fitting shown in FIGS. 13 and 14.
Figure 13:
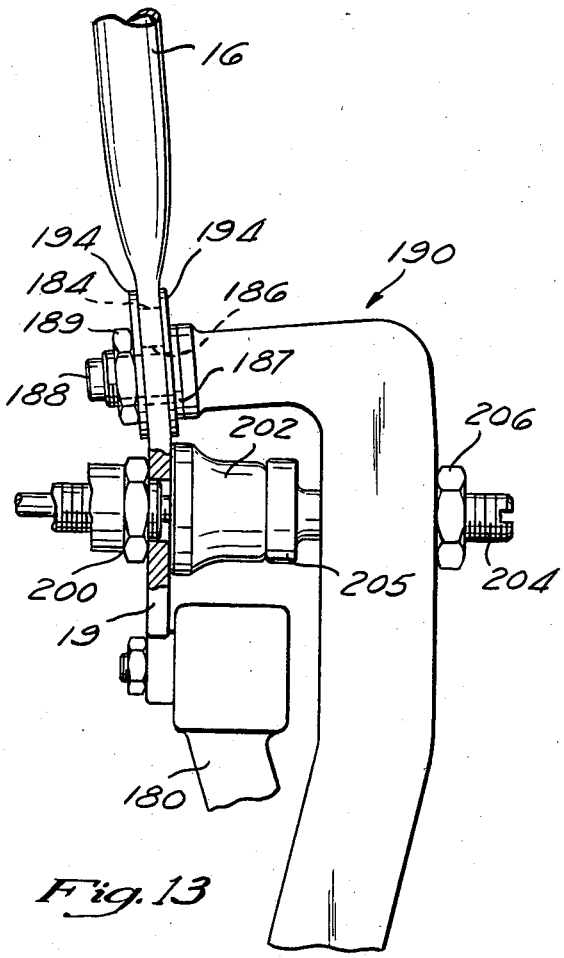
FIG. 13 is a top view of a modified fitting engaging a bicycle axle. This modified fitting adapts to a type of bicycle with quick-release wheels.
Figure 14:
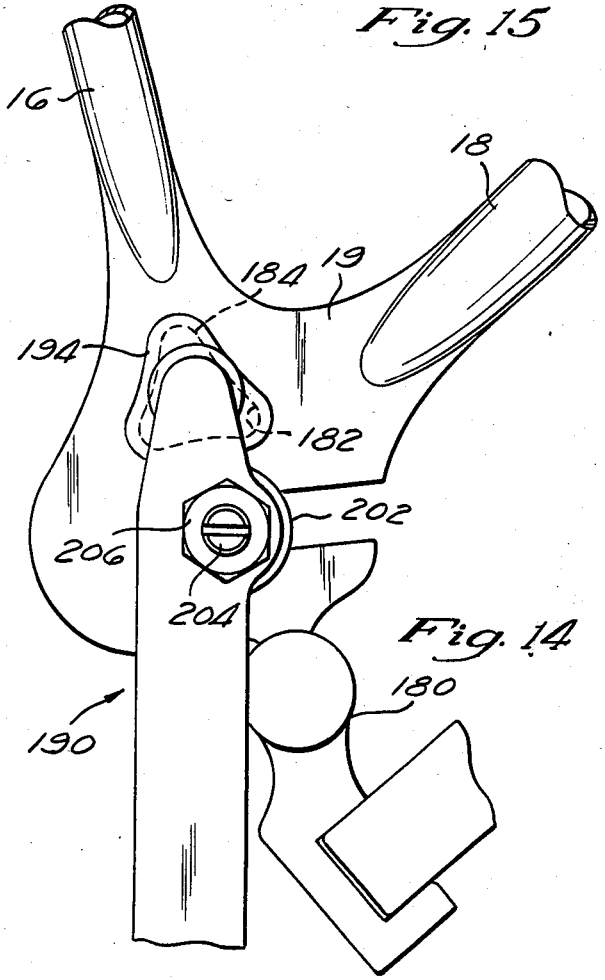
FIG. 14 is a side view of the structure shown in FIG. 13.

FIGS. 13–15 show a bicycle hub construction with quick release of wheels. The quick release mechanism and other parts of the hub and derailer 180 are of conventional configuration on the market. The rear braces 16, 18 meet at a fork 19. This fork 19 differs from some other forks in having a triangular opening 182 for weight reduction. We make use of the triangular opening by providing an adapter plug 184 fitting in opening 182. Plug 184 could be a plastic molding. Plug 184 has an opening 186. A bushing 187 is positioned in opening 186 and is secured by a nut 189. Bushing 187 receives rod 188 on a fitting 190. A pair of face plates 194 sandwich plug 184 and the adjacent surfaces of fork 19. Face plates 194 should be faced with non-scuffing material to protect the finish on fork 19. Rod 188 takes loads in a vertical plane extending longitudinally of this bicycle. If the bicycle fork 19 is changed to have a round opening instead of a triangular opening 182, then bushing 187 can be installed directly in opening 182 and plug 184 is not needed.

The hub assembly 200 ends in a hub nut 202. Fitting 190 has threadedly engaged openings therein in a bolt 204 which has a head 205 abutting hub nut 202. Bolt 204 is secured in adjusted position by a locknut 206. Bolt 204, thus, forms an adjustble abutment to hub nut 202 to take any sideload from the axle.

Having thus described our invention, we do not wish to be understood as limiting ourselves for the exact construction shown and described. Instead, we wish to cover those modifications of our invention which will occur to those skilled in the art upon learning of our invention and which are within the proper scope thereof.

We claim:

1. Exercising apparatus disposed on a supporting surface and supporting the rear axle of a bicycle and said exercising apparatus producing drag by connection to the bicycle rear tire, comprising:

(a) a stand adapted to support said rear tire in a manner so that said rear tire is free to rotate above said supporting surface, said stand adapted to support said rear tire by detachable connection to said rear axle, (b) a flywheel and flywheel support means connected to said stand and supporting said flywheel to rotate transverse of the longitudinal axis of said bicycle, said support means locating said flywheel so that the side of said flywheel is located to directly contact said rear tire whereby when said rear tire is rotated said flywheel is rotated as the sole means to produce drag on said rear tire, (c) said support means adjustably supporting said flywheel so that the axis of rotation of said flywheel can be adjusted to various distances from the central vertical plane of said rear tire to thereby vary drag, and (d) said support means including means for pressing said flywheel to said tire for traction.

2. The subject matter of claim 1 in which said stand includes a pair of struts on each side of the rear of the bicycle for engaging opposite ends of the bicycle rear wheel hub bolt axle, each pair of struts having a vee relationship in both top and side views of said stand, thereby to support said bicycle in a bracing manner.

3. The subject matter of claim 2 in which there is a turnbuckle attached at one end to each pair of struts and attached at the other end to said stand whereby said pairs of struts can be pulled together to engage said bolt axle by the tightening of said turnbuckles.

4. The subject matter of claim 2 in which said stand has a base formed by a tube that is U-shaped in top view and said struts being connected to opposite sides of the U-shaped tube, said stand having a rear cross-tube across the end of said U-shaped tube, and an upright tube attached to said cross-tube for rotatably supporting said flywheel behind said rear tire.

5. The subject matter of claim 2 in which said struts include a pair of fittings, each fitting having a cup-shaped cavity and a cup disposed in said cavity, each cup having a hexagonal recess whereby said cups can engage nuts at the ends of the bicycle rear wheel hub bolt axles, said cups being removably disposed in said cavities of said fittings so that said cups can be changed for different sized nuts.

6. The subject matter of claim 1 in which said flywheel has a flat face on its side contacting said rear tire.

7. The subject matter of claim 1 in which said support means includes a cross-tube extending laterally relative to the central vertical plane of said rear tire, a relatively short, movable tube slidably mounted on said cross-tube, an upright tube secured to and rising from said movable tube, and a fitting secured to the upper end of said upright tube and rotatably supporting said flywheel whereby the drag of said flywheel can be adjusted by shifting of said movable tube on said cross-tube thereby varying the distance from the axis of rotation of said flywheel to said plane of said rear tire.

8. The subject matter of claim 7 in which there is a tension spring attached to said upright tube and to said stand to press said flywheel to said rear tire, said flywheel having a planar side facing said rear tire, and said upright tube being telescopically adjustable and the axis of rotation of said flywheel being adjusted to substantially the same level as the axis of rotation of said rear tire.

9. The subject matter of claim 1 in which said stand has engaging means adapted to support said bicycle by engagement with opposite ends of a rear wheel hub bolt axle on said bicycle, said engaging means on the right side of said bicycle including a circular collar having an opening adapted to fit the exterior contour of a nut on said bolt axle and including a fitting having a semicircular rest engaging said collar, a latch member pivotally mounted on said fitting at the opposite side of said collar from rest and said latch member having an arcuate rest recess engaging said collar and said fitting having means latching said latch member against said collar, whereby said stand can accept load of the weight of said bicycle on the right side through said axle, through said nut on the right side, through said collar, to said fitting.

10. The subject matter of claim 1 in which said stand has fittings on opposite sides of said bicycle including bushings and rods disposed in said bushings, said bushings being adapted to fit in openings in rear forks on said bicycle.

11. The subject matter of claim 10 in which said fittings have bolt abutments adapted to engage the ends of a rear wheel hub bolt axle on said bicycle to take bicycle sideloads, said fittings having threaded openings and said bolt abutments being threadedly engaged in said threaded openings for adjustment of the positions of said bolt abutments, and means to press said fittings towards said rear wheel hub bolt axle to bring said bolt abutments against said rear wheel hub bolt axle.

12. The subject matter of claim 10 in which said plugs having apertures in which said bushings are positioned, and said fittings having a pair of plates on the sides of each plug to abut the adjacent fork surfaces.

13. The subject matter of claim 1 in which said means for pressing said flywheel to said tire includes spring means.

14. Exercising apparatus detachably attaching to and supporting the rear axle of a standard bicycle on a supporting surface, said exercising apparatus producing drag by connection to the bicycle rear tire, comprising:

(a) a stand adapted to support said rear tire in a manner so that said rear tire is free to rotate above said supporting surface, said stand adapted to support said rear tire by detachable connection to said rear axle, (b) a flywheel and flywheel support means connected to said stand and supporting said flywheel to rotate transverse of the longitudinal axis of said bicycle, said support means locating said flywheel behind said rear tire so that the side of said flywheel is located to directly contact said rear tire whereby when said rear tire is rotated said flywheel is rotated as the sole means to produce drag on said rear tire, (c) said support means adjustably supporting said flywheel so that the axis of rotation of said flywheel can be adjusted to various distances from the central vertical plane of said rear tire to thereby vary drag, (d) said stand including a pair of struts on each side of said tire connected together in a vee bracing relationship in both top and side view and one of said struts of each pair of struts having cup-shaped, rear-axle-receiving fittings on its end and being telescopically adjustable to adjust to different heights of bicycles, and (e) said support means including spring tension means attached to said struts for pressing said flywheel to said tire for traction.

15. The method of exercising with a standard bicycle, comprising:

(a) supporting the rear of the bicycle above floor level so that said rear tire will not have traction with the floor, (b) supporting a flywheel to rotate about an axis extending parallel to the central vertical longitudinal plane of said bicycle and pressing the side of said flywheel directly against said rear tire thereby forming the primary means to produce drag on said rear tire, (c) operating said bicycle to rotate said rear tire, and (d) moving the location of the axis of rotation of said flywheel relative to the central vertical plane of said rear tire and thereby varying drag.

* * * * *

UNITED STATES PATENT OFFICE
CERTIFICATE OF CORRECTION

PATENT NO. : 4,593,898
DATED : June 10, 1986
INVENTOR(S) : Carl M. McLerran & Robert E. Johnson It is certified that error appears in the above-identified patent and that said Letters Patent are hereby corrected as shown below:

Column 6, Claim 12, line 1, after "in which", insert -- said fittings include triangular adapter plugs adapted to engage said openings in the rear forks on said bicycle,--.

Signed and Sealed this

*Twenty-third* Day of *September 1986*

[SEAL]

*Attest:*

DONALD J. QUIGG

*Attesting Officer* *Commissioner of Patents and Trademarks*